US008851057B2

(12) United States Patent
Pulkrabek et al.

(10) Patent No.: US 8,851,057 B2
(45) Date of Patent: Oct. 7, 2014

(54) BOW PRESS

(75) Inventors: Larry Pulkrabek, Osceola, IA (US); Jay Engstrom, Port Wing, WI (US); Aaron Pellett, Alborn, MN (US); Dennis Coauette, Duluth, MN (US)

(73) Assignee: Field Logic, Inc., Superior, WI (US)

( * ) Notice: Subject to any disclaimer, the term of this patent is extended or adjusted under 35 U.S.C. 154(b) by 351 days.

(21) Appl. No.: 13/345,168

(22) Filed: Jan. 6, 2012

(65) Prior Publication Data

US 2013/0174823 A1 Jul. 11, 2013

(51) Int. Cl.
*F41B 5/14* (2006.01)

(52) U.S. Cl.
CPC ..... *F14B 5/1449* (2013.01)
USPC ..... 124/86; 124/1

(58) Field of Classification Search
CPC ..... F41B 5/1449
USPC ..... 124/1, 86
See application file for complete search history.

(56) References Cited

U.S. PATENT DOCUMENTS

| | | | | |
|---|---|---|---|---|
| 3,055,655 | A * | 9/1962 | Chelf | 29/235 |
| 5,022,377 | A * | 6/1991 | Stevens | 124/23.1 |
| 5,125,389 | A * | 6/1992 | Paff | 124/86 |
| 5,222,473 | A * | 6/1993 | Lint | 124/86 |
| 5,370,103 | A * | 12/1994 | Desselle | 124/86 |
| 5,425,350 | A * | 6/1995 | Egusquiza | 124/86 |
| 5,433,186 | A * | 7/1995 | Corwin | 124/86 |
| 5,983,879 | A * | 11/1999 | Gifford | 124/1 |
| 6,220,235 | B1 * | 4/2001 | Sands | 124/1 |
| 6,386,190 | B1 * | 5/2002 | Kurtz, Jr. | 124/1 |
| 6,932,070 | B1 * | 8/2005 | Kurtz, Jr. | 124/1 |
| 6,968,834 | B1 * | 11/2005 | Gibbs | 124/1 |
| 7,089,923 | B2 * | 8/2006 | Johnson | 124/1 |
| 7,185,644 | B2 * | 3/2007 | Kurtz, Jr. | 124/1 |
| 7,255,099 | B2 * | 8/2007 | Henry | 124/1 |
| 7,597,094 | B2 * | 10/2009 | Pittman | 124/1 |
| 7,644,708 | B2 * | 1/2010 | Pittman | 124/1 |
| 8,141,546 | B2 * | 3/2012 | Liu | 124/1 |
| 8,387,600 | B1 * | 3/2013 | Horn | 124/1 |
| 8,402,955 | B2 * | 3/2013 | Tulpa | 124/1 |
| 8,505,523 | B1 * | 8/2013 | Horn | 124/1 |
| 8,505,526 | B1 * | 8/2013 | McPherson et al. | 124/86 |
| 2006/0000462 | A1 * | 1/2006 | Kurtz | 124/1 |
| 2006/0191522 | A1 * | 8/2006 | Henry | 124/23.1 |
| 2007/0119438 | A1 * | 5/2007 | Pittman | 124/1 |
| 2009/0056688 | A1 * | 3/2009 | Marsh et al. | 124/1 |
| 2009/0107475 | A1 * | 4/2009 | Pittman | 124/86 |
| 2010/0089376 | A1 * | 4/2010 | Bunk et al. | 124/86 |
| 2011/0162631 | A1 * | 7/2011 | Tulpa | 124/86 |
| 2011/0232616 | A1 * | 9/2011 | Gouramanis | 124/1 |

OTHER PUBLICATIONS

Apple Archery, 2011 Apple Archery Catalog Superior Archery Service & Repair Tools, pp. 1 through 7, Manchester, PA.

* cited by examiner

*Primary Examiner* — Gene Kim
*Assistant Examiner* — Alexander Niconovich
(74) *Attorney, Agent, or Firm* — Stoel Rives LLP

(57) ABSTRACT

A bow press for deflecting bow limbs of a bow. Inside and outside support members are provided to engage the bow limbs and/or riser on the bow. Rotating support members roll on outside surfaces of the bow limbs to deflect the bow limbs toward the center portion in response to the actuator mechanism is extended.

22 Claims, 14 Drawing Sheets

BOW PRESS

FIELD OF THE INVENTION

This disclosure relates to a bow press are used for installing, replacing, or adjustment of a bow string or components of bows.

BACKGROUND OF THE INVENTION

Compound bows are widely used by archers. The popularity of the compound bow is mainly due to the advantage provided in the reduced pull force required at full draw together with the resulting increase in accuracy. The pull on the bow string is high at the beginning of the draw where the archer at this point is able to exert maximum force. As the draw progresses a little beyond mid-point, there is an over-center action on eccentrically mounted pulleys or cams of the compound bow which decreases the draw force needed to maintain the bow string in the drawn position, while maximizing the energy stored in the limbs of the bow. Thus, at full draw it is relatively easy to hold the arrow and bow string and much easier to perfect aiming technique and proper release resulting in increased accuracy.

A typical compound bow includes one or more eccentrically mounted pulleys or cams pivotably attached relative the bow limbs and serves to support and control the movement of a bow string. Stringing or tuning of compound bows is critical to achieve a proper balance or synchronization of the eccentrically mounted pulleys or cams. The complexity of the stringing and the sensitivity to proper tuning of the bow makes it undesirable to unstring the bow when it is not in use. In some cases it is impossible to string and tune such a bow without the aid of an apparatus commonly known as a bow press.

Since a compound bow cannot be conveniently unstrung and restrung, they are virtually always left in a strung condition. Periodic retuning of compound bows, however, is required to maintain desired performance levels, and to change, replace or repair components of the compound bow, such as the bow string, string sights, dampers, the tension cable, the cams and other components. Through the years a number of bow presses have been developed for facilitating stringing, tuning, and maintenance of compound bows, such as for example, U.S. Pat. Nos. 5,222,473; 5,370,103; 5,433,186; 6,386,190; and 7,185,644.

FIG. 1 illustrates the prior art bow press 200 disclosed in U.S. Pat. No. 5,370,103 (Desselle). Outside surfaces of the limbs 202 of the bow 204 are positioned on outer supports 206. Inner members 208 are engaged with inside surface of riser 210. Drive system 212 moves member 214 in direction 216, causing the limbs to deflect in direction 218. The bow press 200 lacks any specific structure to prevent the bow 204 from moving side-to-side. If the bow 204 is not placed in the press 200 symmetrically with respect to the supports 206, 208, lateral shifting can occur under pressure. If a limb 202 breaks the bow 204 will be ejected from the press 200. With compound bows typically generating forces in excess of 1500 pounds, there is significant danger of damage to the bow and the press and injury to the operator.

If the member 214 is moved too far and the outer support 206 moves past the limb tips 220, the bow 204 to be ejected from the bow press 200. Consequently, the outer supports 206 are typically not located near the bow limb tips. As a result, the bending force applied by the press 200 is concentrated between the outer supports 206 and the riser 210, creating a risk of limb damage.

FIG. 2 illustrates the prior art bow press 250 disclosed in U.S. Pat. No. 7,644,708 (Pittman). Finger assemblies 252 on the bow press 250 are configured to engage with tips of the limbs 254 on the bow 256. Motor 258 displaces the finger assemblies 252 toward and away from each other to deflect the limbs 254. Without any additional restrains on the bow 256, disengagement of one or both of the finger assemblies 252 from the tips of the limbs 254 can result in the bow 256 being ejected from the press 250 in essentially any direction, at very high velocity. If a bow limb breaks the bow press 250 includes no structure to prevent the bow 256 from being launched in a random direction.

The safety concerns surrounding prior art bow presses have increased with changes in limb design. FIG. 3 illustrates a compound bow 270 with parallel or near-parallel limbs 272. The bow 270 includes a long riser 274 and short swept back limbs 272 that are oriented generally parallel. The limb tips 278 are typically past parallel at full draw. The limbs 272 of the bow 270 of FIG. 3 are past parallel 280 even before the string 276 is drawn. In order to remove the tension on the string 276 the limbs 272 must be flexed well past parallel.

Once the limbs 272 are past parallel, there is no structure on the bow press 200 of FIG. 1 preventing the bow 270 from being ejected in the direction 216. In fact, the shape of the limbs 272 encourages the bow 270 move in the direction 216. Past-parallel bows have an even great chance of dislodging from the finger assemblies 252 of the bow press 250. As a result, secondary securing devices, such as straps, are required to secure many modern bows to the bow presses 200 and 250.

BRIEF SUMMARY OF THE INVENTION

The present disclosure relates to a bow press that can safely deflect bow limbs of virtually any type of bow. The support structures of the present bow press positively secure the riser and/or bow limbs, without the need for cumbersome and time consuming add-on fixation structures, such as straps or clamps. The rotating support members near the bow tip concentrate the force near the bow cam axes without capturing the tips of the limbs. Openings in the rotating support members provide access to the bow cams during pressing.

In one embodiment, the bow press includes a pair of pivot arms each pivotally attached to pivot arm brackets that slide along a support rail on opposite sides of a center portion. A pair of opposing support members are attached to each of the pivot arm brackets that are adapted to engage the bow limbs and/or the riser. A pair of linkage brackets are provided that slide along each of the pivot arms. A pair of links pivotally connect the linkage brackets to an actuator mechanism that is adapted to simultaneously move the links toward and ways from the support rail. Support members attached to each of the linkage brackets are adapted to engage outside surfaces of the bow limbs. The support members are adapted to simultaneously deflect the bow limbs generally away from the support rail and toward the center portion in response to the actuator mechanism moving the links ways from the support rail.

It will be appreciated that the present bow press can also be used with crossbows. The pair of opposing support members engage the limbs rather than the riser. The pivot arm brackets are preferably positioned adjacent to the riser of the crossbow and the linkage brackets are positioned near the distal ends of the crossbow limbs.

In one embodiment, the pair of opposing support members include an inside support members moveably attached to each of the pivot arm brackets and an outside support member. The inside support members preferably include ratcheting mechanisms that permit free movement toward the outside support members, but restricts movement way from the outside support members. In one embodiment the support members compressively engage the riser and/or the limbs. A release is provided that disengages the ratcheting mechanisms so the inside support members can be displaces away from the outside support members. The outside support members are preferably releasably attached to the pivot arm brackets.

A biasing mechanism is provided that suspends the pivot arms in a neutral position above the support rail. A drive mechanism is optionally included that simultaneously moves the pivot arm brackets toward or away from the center portion of the support rail to compensate for the size of the bow.

In one embodiment, a ratcheting mechanism is provided to adjust a distance between the linkage brackets and the actuator mechanism. In one embodiment, the ratcheting mechanism includes a first position that lock the links in position, a second position that permits the links to slide freely relative to the ratcheting mechanism, and a third position that permits ratcheting between the links and the ratcheting mechanism.

In one embodiment, at least one locking mechanism attaches the links to the actuator mechanism. The locking mechanism includes center pins biased to releasably engage with apertures in the links and protrusions on the center pins adapted to retain the center pins in a disengaged relationship with the links.

In another embodiment, the support members are rotating support members. The rotating support members can be crescent shaped, cam shaped, or a variety of other configurations. In one embodiment, the rotating support members include at least two freely rotating wheels attached to the linkage brackets by shafts and adjustment mechanisms adapted to adjust a separation between the rotating wheels along the shafts. The support members are adapted to engage with the bow limbs proximate bow limb cam axes.

The present disclosure is also directed to a bow press that includes a pair of pivot arms each pivotally attached to pivot arm brackets that slide along a support rail on opposite sides of a center portion. Support members are attached to the pivot arm brackets that are adapted to engage the bow limbs and/or the riser of a bow. A pair of linkage brackets are provided that slide along each of the pivot arms. A pair of links pivotally connect the linkage brackets to an actuator mechanism that is adapted to simultaneously move the links toward and ways from the support rail. A ratcheting mechanism engaged with the links is provided to adjust a distance between linkage brackets and the actuator mechanism. Support members attached to each of the linkage brackets are adapted to engage outside surfaces of the bow limbs. The support members are adapted to simultaneously deflect the bow limbs generally away from the support rail and toward the center portion in response to the actuator mechanism moving the links ways from the support rail.

The ratcheting mechanism preferably permits the links to be freely moved away from the support rail, but restricts movement of the links toward the support rail. In one embodiment, the ratcheting mechanism includes three positions. A first position locks the links in place. A second position permits the links to slide freely in the locking mechanism. A third position permits ratcheting between the links and the locking mechanism.

The present disclosure is also directed to a bow press that includes a pair of pivot arms each pivotally attached to pivot arm brackets that slide along a support rail on opposite sides of a center portion. Support members are attached to the pivot arm brackets that are adapted to engage the bow limbs and/or the riser of a bow. A pair of linkage brackets are provided that slide along each of the pivot arms. A pair of links pivotally connect the linkage brackets to an actuator mechanism that is adapted to simultaneously move the links toward and ways from the support rail. A biasing mechanism suspends the pivot arms in a neutral position above the support rail. Support members attached to each of the linkage brackets are adapted to engage outside surfaces of the bow limbs. The support members are adapted to simultaneously deflect the bow limbs generally away from the support rail and toward the center portion in response to the actuator mechanism moving the links ways from the support rail.

The present disclosure is also directed to a method of operating a bow press to deflect bow limbs of a bow. The method includes adjusting a separation between a pair of pivot arm brackets along a support rail relative to a center portion to correspond to the bow riser. Adjustable support members are engaged with the bow limbs and/or the riser. The adjustable support members are preferably locked into engagement with the riser. Linkage brackets slide along pivot arms that are pivotally attached to the pivot arm brackets so that rotating support members attached to the linkage brackets are positioned to engage outside surfaces of the bow limbs. Links pivotally connect the linkage brackets to an actuator mechanism coupled to the support rail proximate the center portion. The actuator mechanism is extended to simultaneously move the rotating support members away from the support rail and toward the center portion. The rotating support members rotate along the outer surfaces of the bow limbs to deflect the bow limbs toward the center portion.

DETAILED DESCRIPTION OF THE EXEMPLARY EMBODIMENTS

Figure 1:
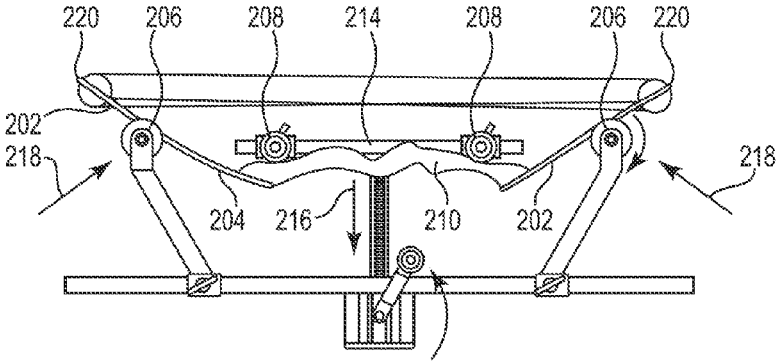
FIG. 1 is a prior art bow press that engages the bow limbs.
Figure 2:
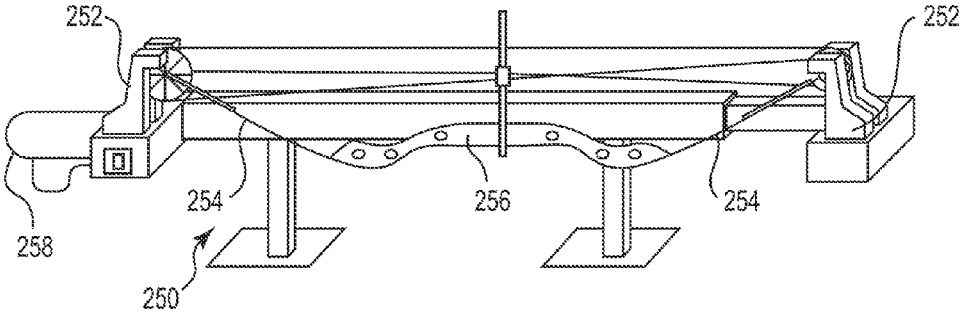
FIG. 2 is an alternate prior art bow press that engaged tips of the limbs.
Figure 3:
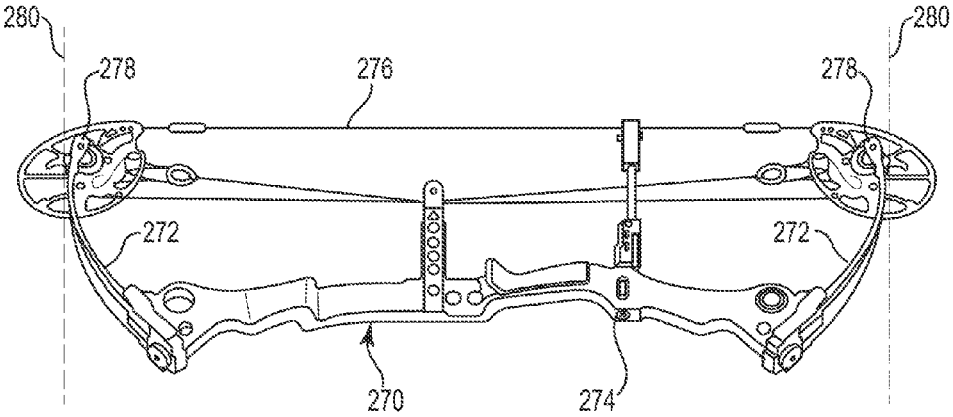
FIG. 3 is an exemplary bow with near parallel or past parallel limbs.
Figure 4:
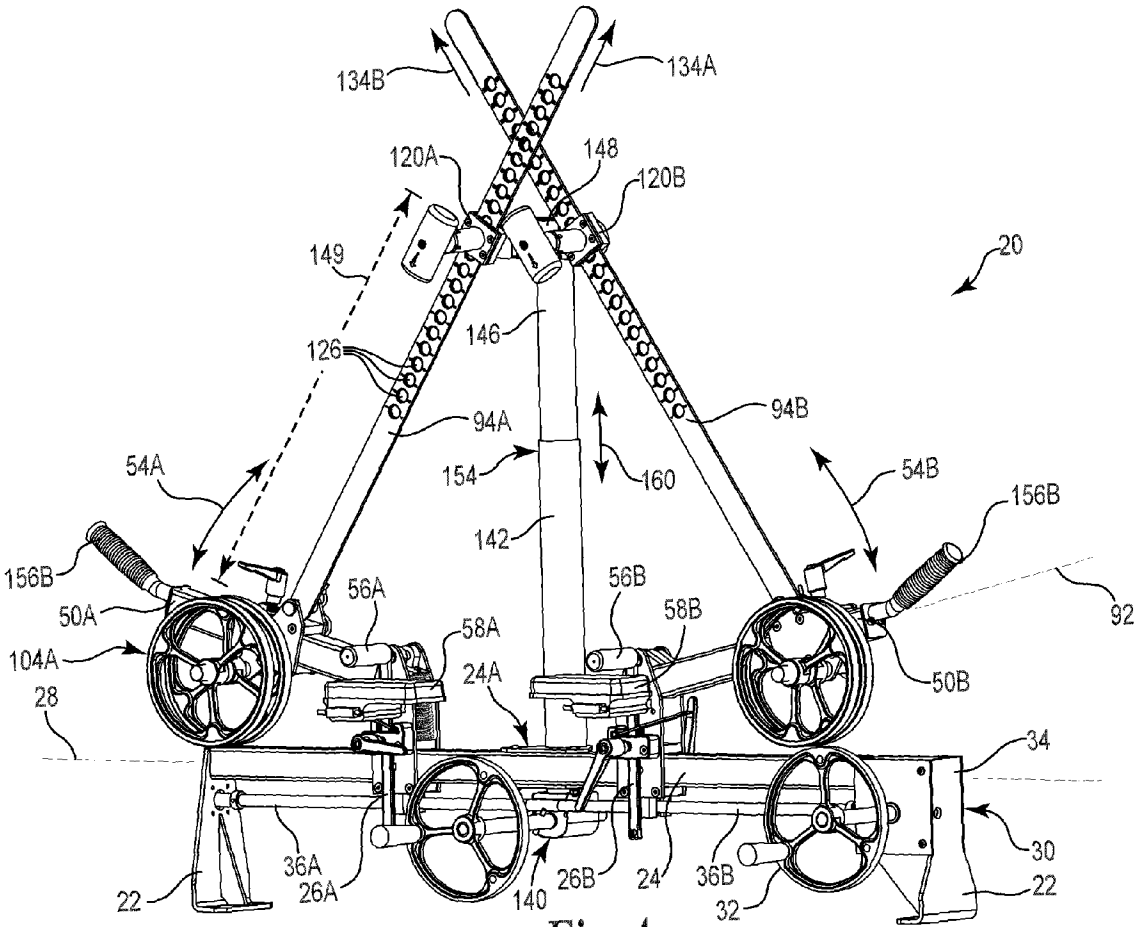
FIG. 4 is a perspective view of a bow press in accordance with an embodiment of the present disclosure.
Figure 5:
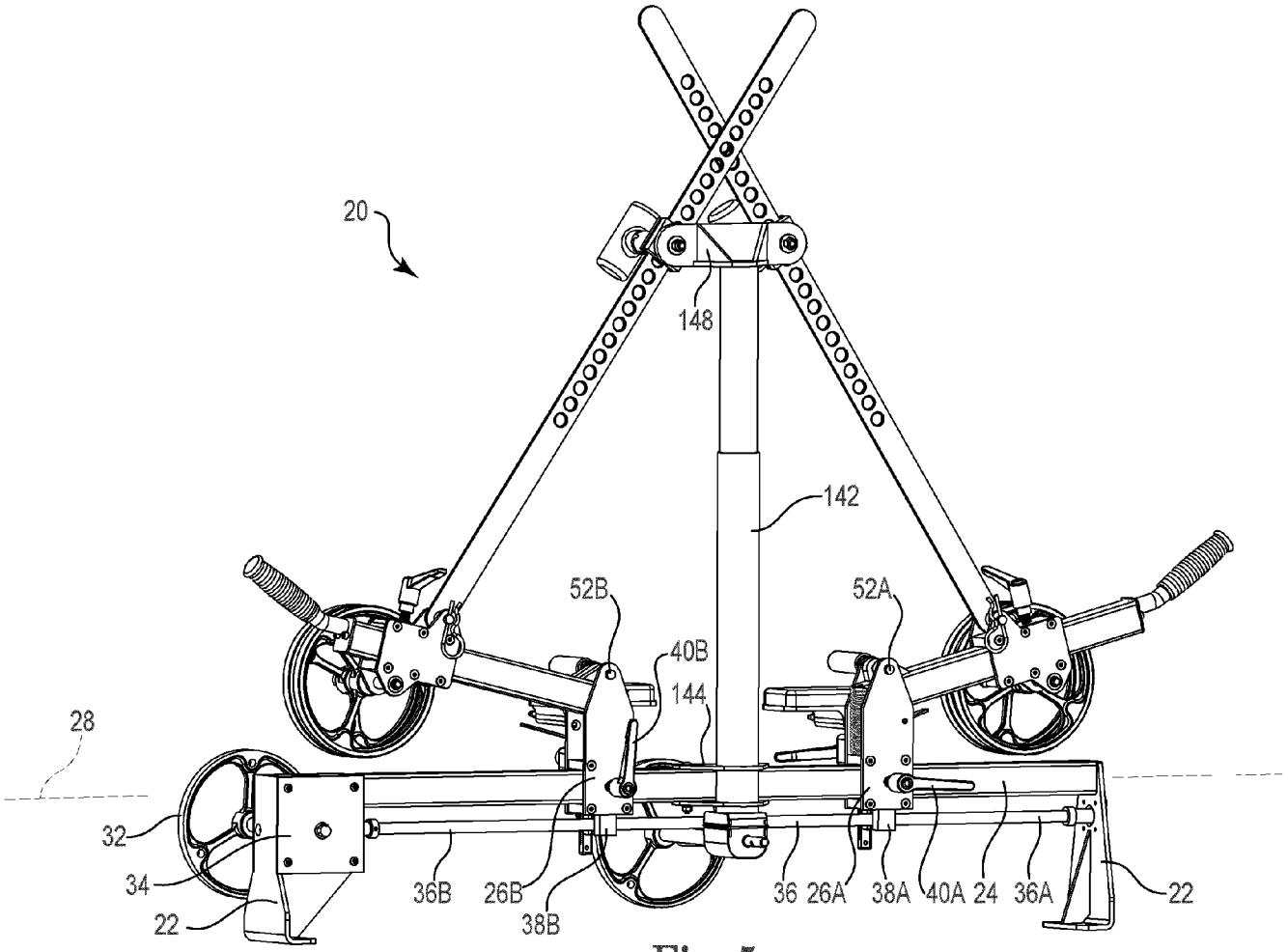
FIG. 5 is a rear view of the bow press of FIG. 4.
Figure 6:
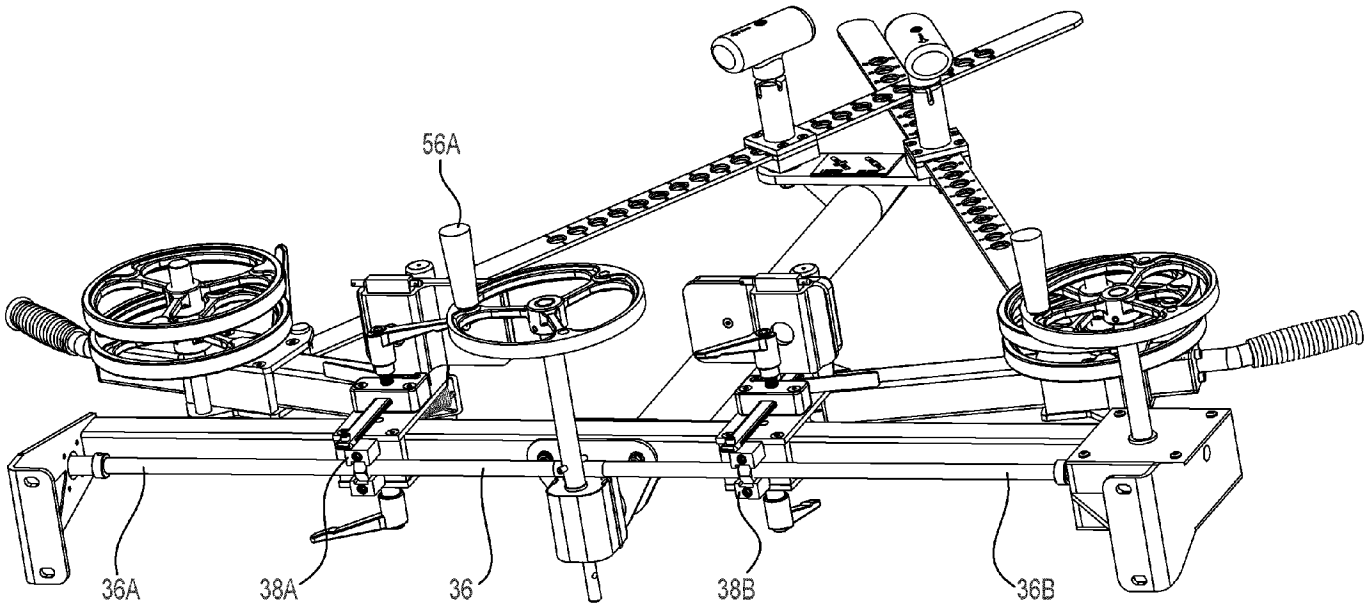
FIG. 6 is a bottom perspective view of the bow press of FIG. 4.

FIGS. 4 through 6 illustrate an exemplary a bow press 20 in accordance with an embodiment of the present disclosure. The bow press 20 includes base members 22 support rail 24 along which pivot arm brackets 26A, 26B ("26") are moved relative to longitudinal axis 28 using drive mechanism 30. The pivot arm brackets 26 are preferably located on opposite sides of center portion 24A of the support rail.

The drive mechanism 30 includes handle 32 coupled to gear box 34 that rotates ball screw 36. As best illustrated in FIG. 6, the ball screw 36 is coupled to the pivot arm brackets 26 by threaded couplings 38A, 38B. The threaded coupling 38A preferably has left-handed threads and the right threaded coupling 38B includes right handed threads, so the pivot arm brackets 26 move symmetrically toward or away from each other, depending on the direction the handle 32 is turned. An alternate mechanism for symmetrically moving the pivot arm brackets 26 is disclosed in commonly-owned U.S. Pat. No. 6,968,834 (Gibbs), which is hereby incorporated by reference.

Figure 10:
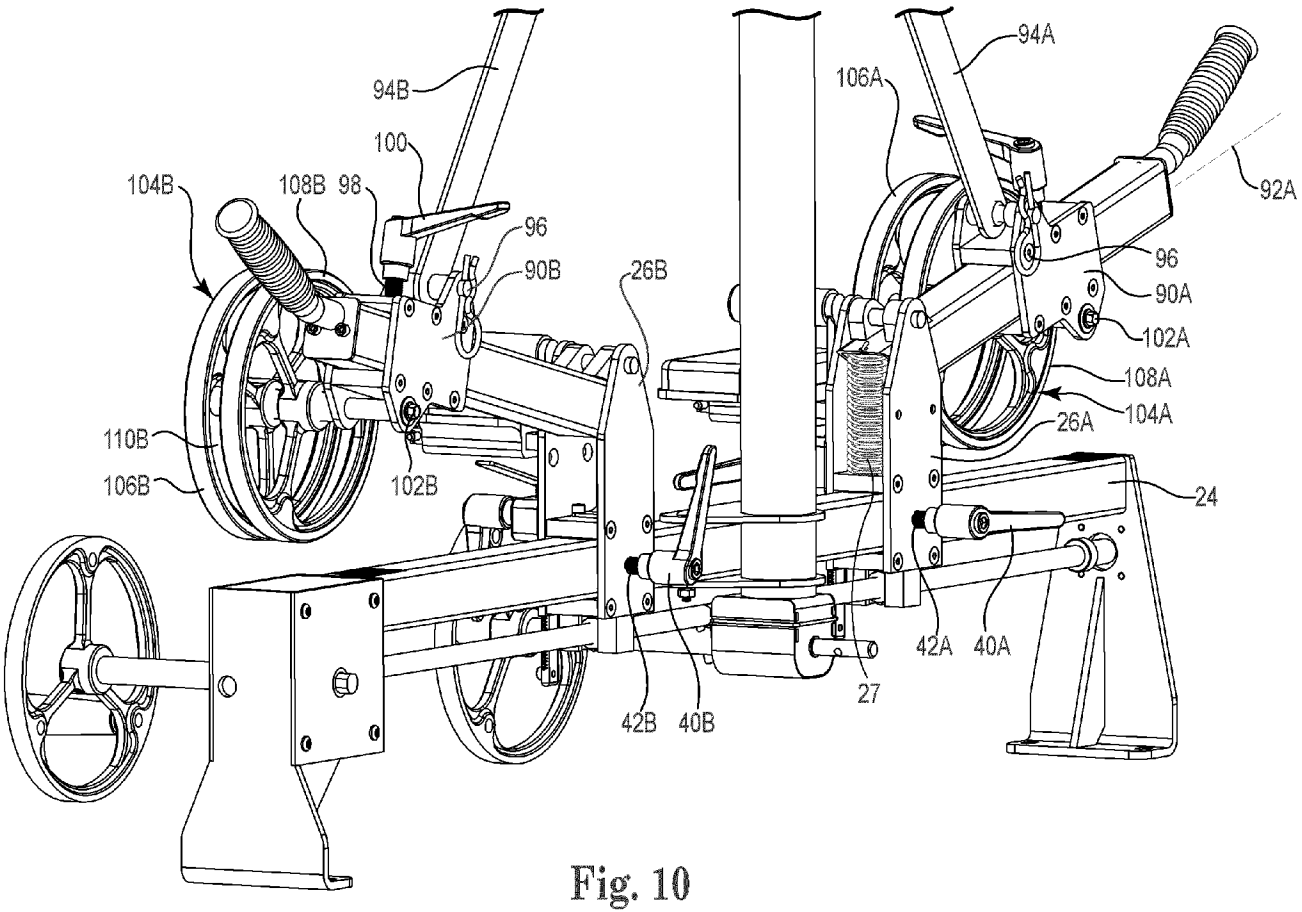
FIG. 10 is a perspective view of an actuator mechanism on the bow press of FIG. 4.

Pivot arms 50A, 50B ("50") are pivotally attached to the respective pivot arm brackets 26A, 26B by pivot pins 52A, 52B ("52") to permit the pivot arms 50 to move along arcs 54A, 54B ("54"). As best illustrated in FIG. 10, the pivot arm brackets 26 preferably include handles 40A, 40B ("40") attached to threaded members 42A, 42B ("42") that fix the location along the rail 24. The pivot arm brackets 26 are preferably infinitely adjustable along the axis 28. Spring mechanisms 27 preferably bias the pivot arms 50 away from the rail 24. The spring force of the spring mechanisms 27 is preferably sufficient to suspend the pivot arms 50 in a neutral position above the rail 24. The "floating" pivot arm 50 facilitates adjustment of the present bow press 20.

Figure 7:
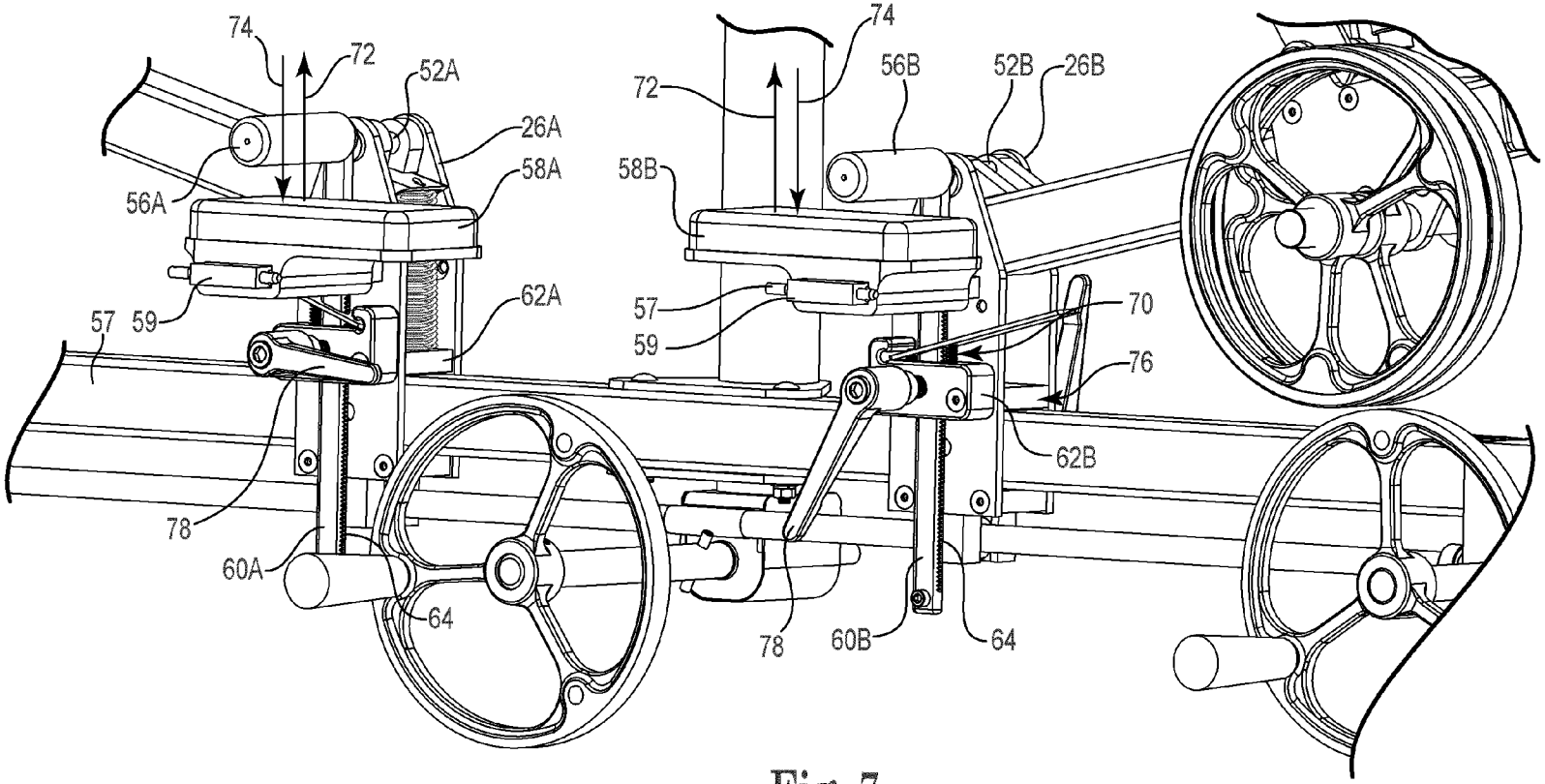
FIG. 7 is an enlarged view of adjustable outside support members on the bow press of FIG. 4.
Figure 8:
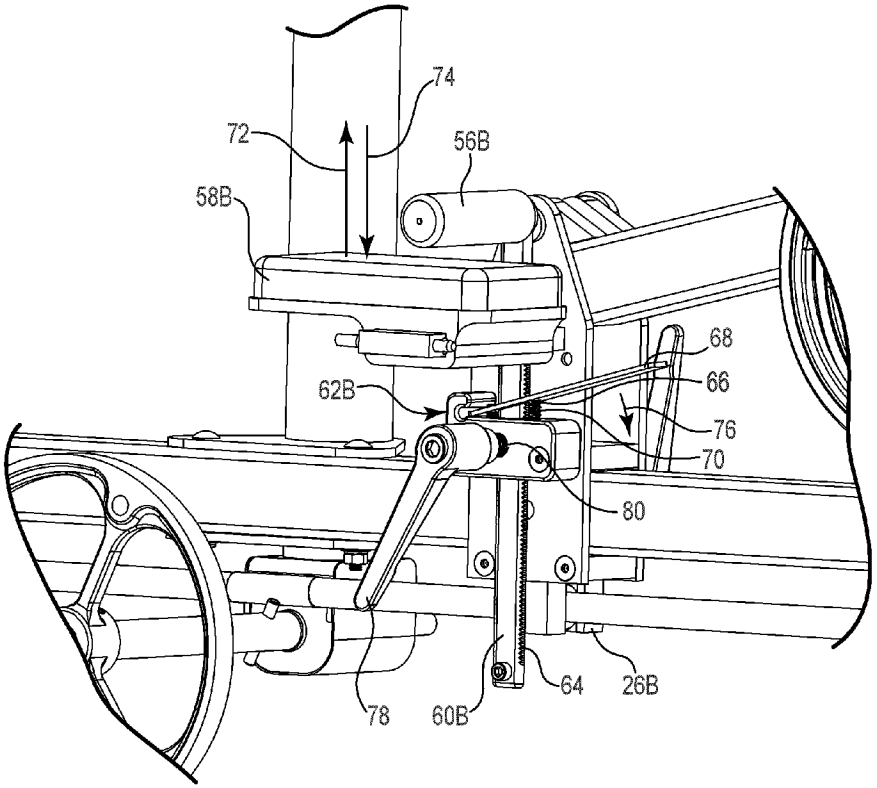
FIG. 8 is an enlarged view of ratcheting mechanisms for the adjustable outside support members on the bow press of FIG. 4.

As best illustrated in FIGS. 7 and 8, outside support members 58A, 58B ("58") are attached to the pivot arm brackets 26 at a location below the inside support members 56. In the preferred embodiment, the outside support members 58 are releasably attached to the pivot arm brackets 26 by pins 57. By removing the pins 57, the outside support members 56 can be slide off of support arms 59 and reversed (see e.g., FIG. 13) or alternate outside support members substituted. For example, an outside support member 56 with a particular shape corresponding to the particular bow arms may be easily attached to the present bow press 20.

Inside support members 56A, 56B ("56") are movably attached to the pivot arm brackets 26 by extension members 60A, 60B ("60") that slide in ratcheting mechanisms 62A, 62B ("62"). In the illustrated embodiment, the extension members 60 include teeth 64 that engage with edges 66 in release levers 68. The levers 68 are preferably biased in the locked position by springs 70. As used herein, "ratchet" or "ratcheting" refers to a mechanism that allows continuous linear or rotary motion in only one direction while preventing motion in the opposite direction.

In operation, the ratcheting mechanisms 62 permit the inside support members 56 to move independently in direction 74 toward outside support members 58 to capture the riser (see e.g., FIG. 14) or the bow limbs, such as on a crossbow. As used herein, "riser" refers to a center member connecting a pair of discrete limbs, such as on a compound bow or a crossbow, or the center region of a traditional bow where the bow limbs are a continuous structure, such as on a laminated bow or composite bow.

The levers 68 engage with the teeth 64 to prevent the inside support members 56 from moving in opposite direction 72. To release the ratcheting mechanisms 62, the levers 68 are moved in direction 76 to disengage the edges 66 from the teeth 64. Once the support members 56 are in the desired locations, handles 78 are rotate to advance threaded members 80 into the ratcheting mechanisms 62 to compressively engage with the extension members 60. The threaded members 80 serve to secure the extension members 60 relative to the pivot arm brackets 26.

Figure 14:
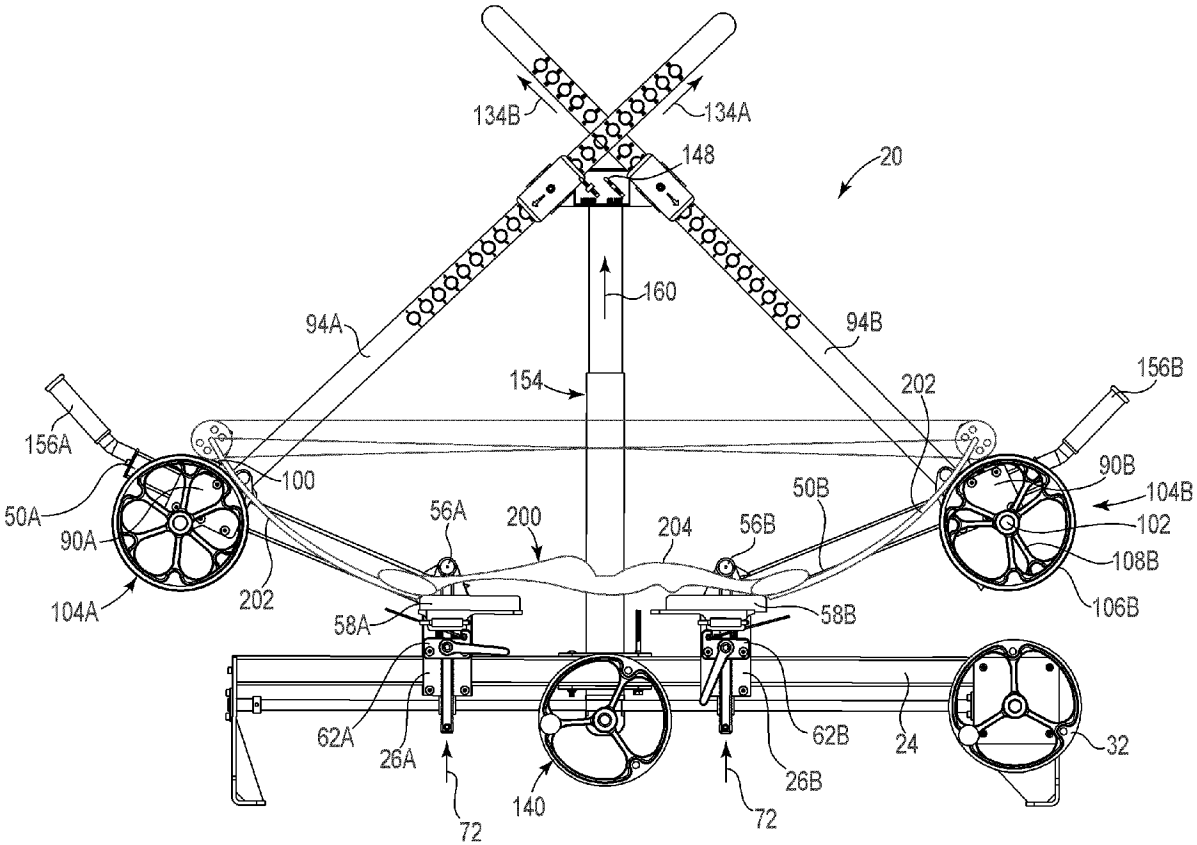
FIG. 14 illustrates a compound bow mounted in the bow press of FIG. 4.
Figure 15:
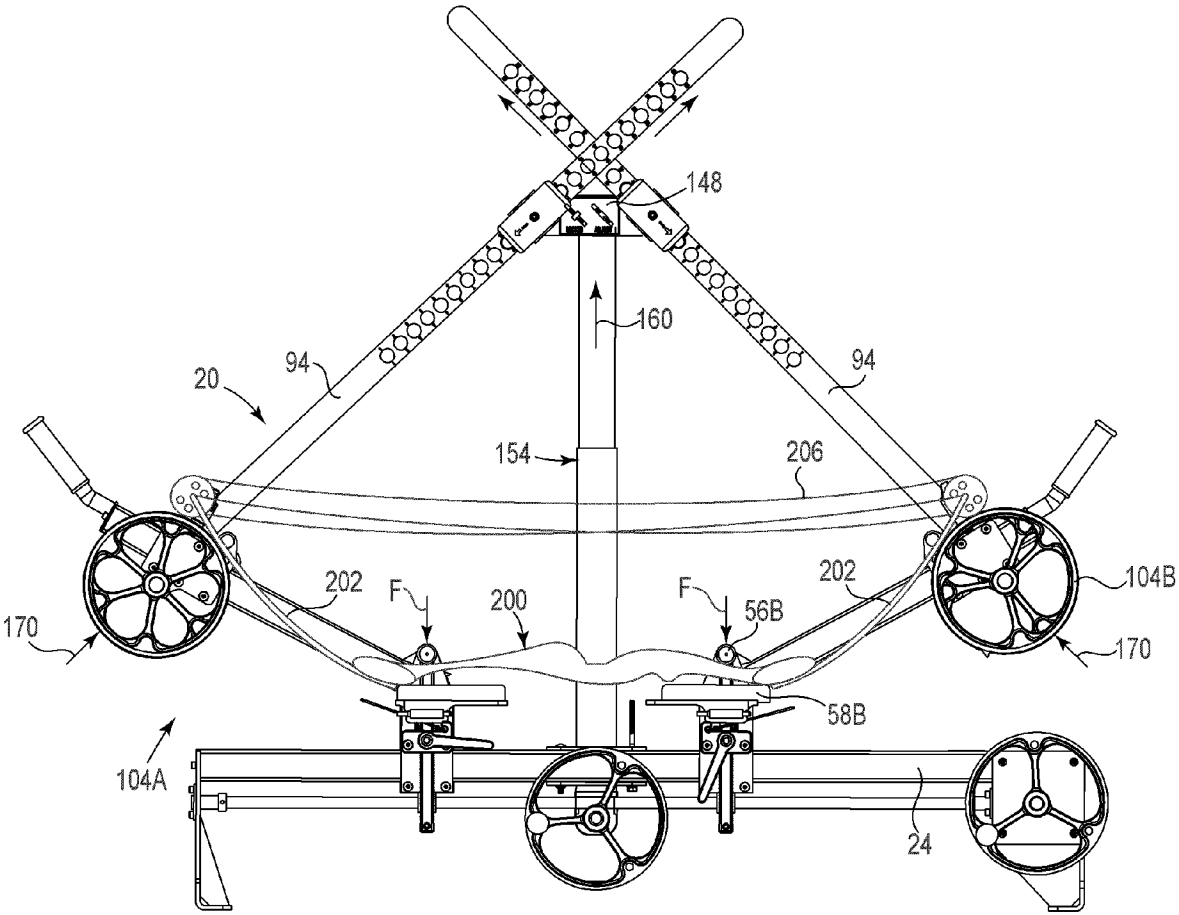
FIG. 15 illustrates deflection of the bow limbs of the bow in the bow press of FIG. 14.

The opposing support members 56, 58 serve to positively lock or secure the bow the press 20 (see e.g., FIGS. 14 and 15). Locating the opposing support members 56, 58 on the pivot arm brackets 26 positions the opposing compressive forces F near the axis of rotation 52 of the pivot arms 50.

Figure 9:
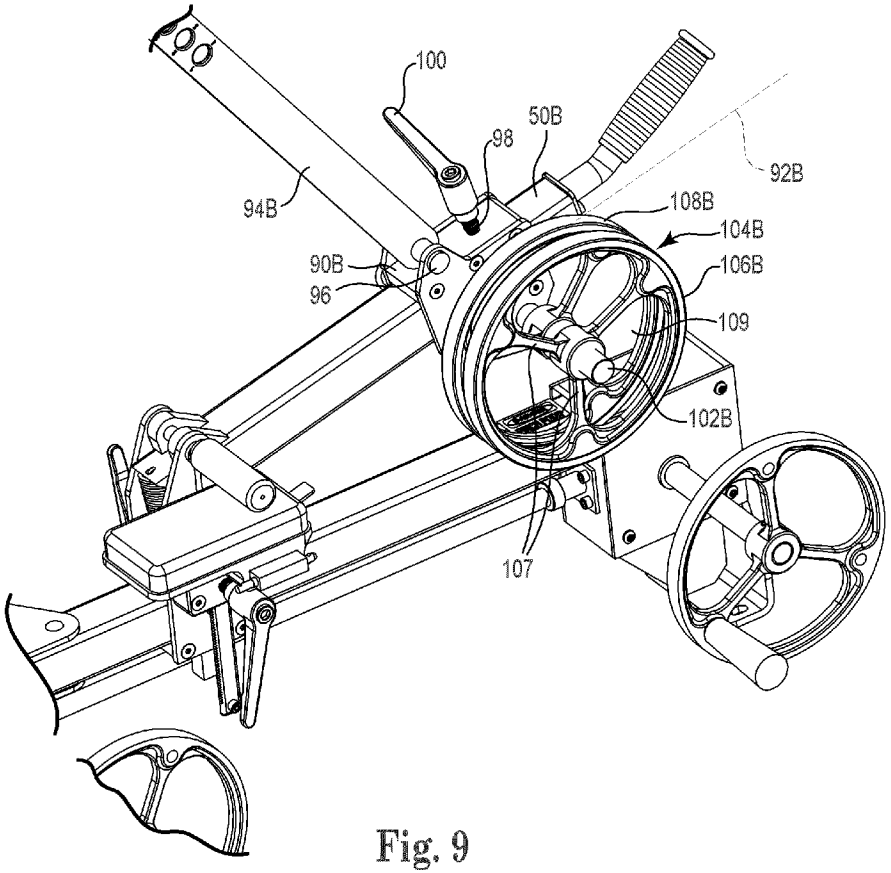
FIG. 9 is an enlarged view of the rotating support members on the bow press of FIG. 4.
Figure 11:
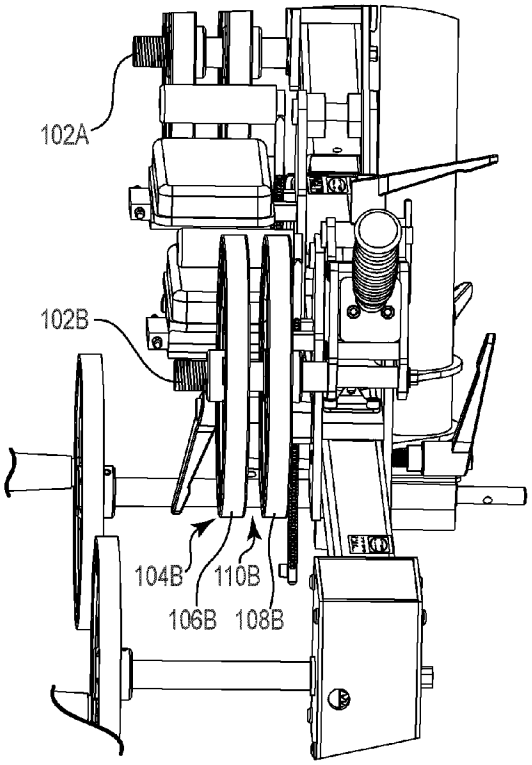
FIG. 11 illustrates an adjustment mechanism for the rotating support members of FIG. 4.

As best illustrated in FIGS. 9 through 11, each pivot arm 50 includes a sliding linkage bracket 90A, 90B ("90") that slides along axes 92A, 92B ("92"). The sliding linkage brackets 90 are preferably infinitely adjustable along the pivot arms 50. Links 94A, 94B ("94") are pivotally attached to the linkage brackets 90 by pivot pins 96. Threaded members 98 attached to handles 100 are provided to lock or fix the linkage brackets 90 alone the axes 92.

The linkage brackets 90 also include shafts 102A, 102B ("102") that support one or more rotating support members 104A, 104B ("104"). In the illustrated embodiment, each rotating support member 104 is a plurality of wheels 106A, 106B ("106") and 108A, 108B ("108"). Alternatively, the rotating support members 104 can be cam shaped, crescent shape (see e.g. FIG. 16), or a variety of other shapes. The rotating support members 104 also preferably include spokes 107 with large openings 109 to provide access to the bow limb tips and bow cams during repair. In one embodiment, the wheels 106, 108 have a diameter of about 6 inches to about 10 inches.

The protruding portions of the shafts 102 are preferably threaded to permit gaps 110A, 110B ("110") to be adjusted to correspond with the width of the bow limbs. The rotating support members 104 can be configured to concentrate the bending forces near the bow cam axes 208 (see FIG. 15), without capturing the limb tips. The openings 109 provide access to the bow cams during pressing.

Figure 12:
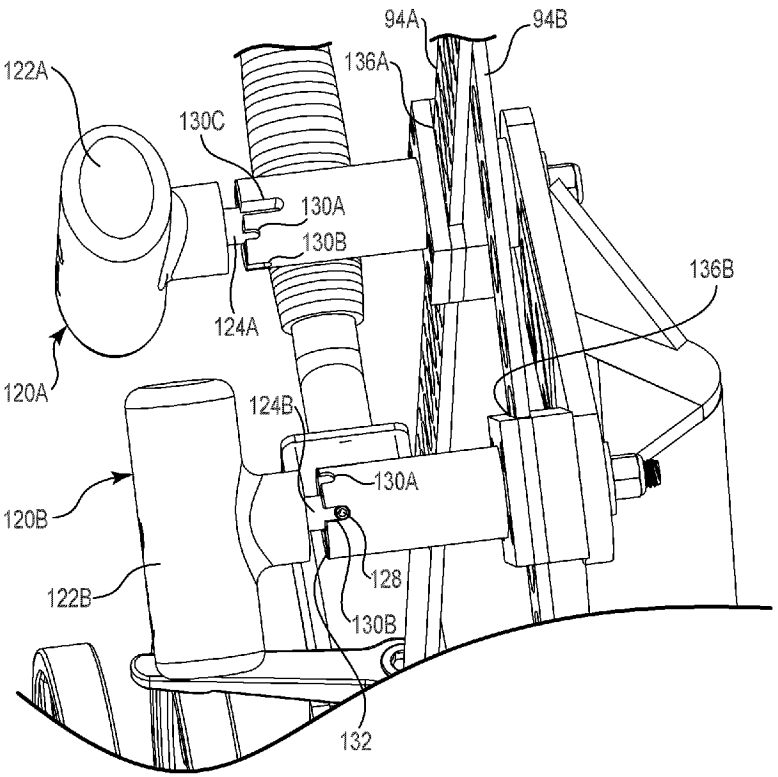
FIG. 12 is a perspective view of a locking mechanism for the links on the bow press of FIG. 4.

As best illustrated in FIGS. 4 and 12, the links 94 slide in slots 136A, 136B ("136") in locking mechanisms 120A, 120B ("120") attached to bracket 148. The locking mechanisms 120 include handles 122A, 122B ("122") with center pins 124A, 124B ("124") that are biased into engagement with holes 126 in the links 94.

In the illustrated embodiment, the locking mechanism 120 is adjustable. The center pins 124 include protrusions 128 that can be located in one of a plurality of slots 130A, 130B, 130C ("130") that control the depth of the center pins 124 relative to the links 94. The first slot 130A retains the center pin 124 in a location disengaged from the links 94, permitting the links 94 to move freely in the slots 136. The second slot 130B positions the center pin 124 to permit a ratcheting motion with the links 94. In the preferred embodiment, the distal ends (not shown) of the center pins 124 include a bevel that allows a ratcheting mechanism of the links 94 to slide upward in directions 134A, 134B ("134"). The third slot 130C retains the center pin 124 in a locked configuration that prevents the links 94 from moving.

The links 94 are used to control the distance 149 between the bracket 148 and the linkage brackets 90. In an alternate embodiment, the links 94 can be two-part telescoping structures. The telescoping feature can be used to control the distance 149. The telescoping feature preferably include a ratcheting structure that permits the distance 149 to be reduced, but resists lengthening.

Figure 13:
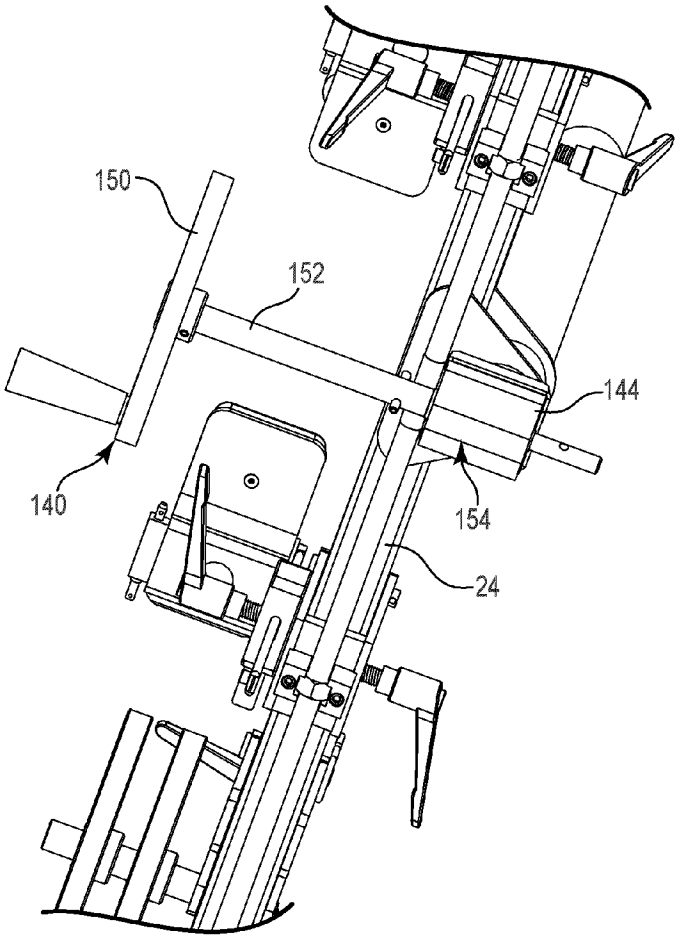
FIG. 13 is a bottom view of a bevel gear assembly for the actuator mechanism on the bow press of FIG. 4.

As best illustrated in FIGS. 4 and 13, actuation mechanism 140 includes a center column 142 attached to the rail 24 by bracket 144. The center column 142 includes telescoping member 146 extendible and retractable along actuator axis 160. The telescoping member 146 is attached to the locking mechanisms 120 by locking mechanism bracket 148. The actuation mechanism 140 automatically maintains symmetry between the components 26, 94 as the bracket 148 is moved toward and away from the support rail 24. In the preferred embodiment, the center column 142 includes a jack screw 154 that extends and retracts the extendible member 146 relative to the rail 24.

As best illustrated in FIG. 13, the bracket 144 supports handle 150 and shaft 152 that operates bevel gear assembly 154. Rotation of the handle 150 operates the jack screw 154 to raise and lower the locking mechanism bracket 148. The location of the locking mechanism bracket 148 relative to the rail 24 is preferably infinitely adjustable. The screw jack 154 functions as an extensible force for applying bending force to the limbs of a bow mounted in the bow press 20.

Operation of the exemplary embodiment of the bow press 20 is illustrated in FIGS. 14 and 15. The bow 200, in either a strung or an unstrung condition, is placed into the bow press 20, generally in the orientation shown. In the embodiment of FIG. 14, bow limbs 202 are in an extended configuration.

The handle 32 is rotated to position the pivot arm brackets 26 relative to riser 204 on the bow 200. The inside support members 56 are moved in the direction 74 until the riser 204 is compressively engaged against the outside support members 58. Compressive forces F serve to positively lock the bow 200 to the pivot arm brackets 26. The ratcheting mechanisms 62 retain the inside support members 56 in the compressed configuration (see FIG. 7). Handles 78 are rotated to lock the inside support members 56 in position (see FIG. 7).

The sliding linkage brackets 90 are slid along the pivot arms 50 (see FIG. 12) until the rotating support members 104 are positioned at the correct position relative to the limbs 202. As will be discussed below, the rotating support members 104 preferably engage the limbs 202 proximate the bow cam axes 208, preferably within two inches of the bow cam axes 208. The wheels 106, 108 are rotated on threaded shafts 102 to set the desired gap 110 for width of the limbs 202.

The handles 100 are then rotated to lock the sliding linkage brackets 90 in position. The intersection point between the links 94 relative to the bracket 148 may also be adjusted to bring the rotating support members 104 into contact with the limbs 202. Handles 156A, 156B ("156") are provided to adjust the positions of the pivot arms 50.

Once the bow press 20 is adjusted, the handled 150 is then rotated to extend the jack screw 154 in direction 160, displacing the bracket 148 away from the support rail 24 and bending the limbs 202, as illustrated in FIG. 15. The displacement of the bracket 148 is translated by the links 94 as force 170 on the bow limbs 202.

The rotating support members 104 roll along the bow limbs 202 to provide a smooth transition between the extended configuration in FIG. 14 to the bent configuration in FIG. 15. As the limbs 202 are bent inward, the tension on bow string 206 is relaxed.

In the compressed configuration of FIG. 15, the rotating support members 104 preferably engage the limbs 202 on opposite sides of the bow cam axes 208 or within 2 inches of the bow cam axes 208. Concentrating the bending forces near the bow cam axes 208 distributes the force 170 along substantially the full length of the limbs 202, reducing the chance of damage to the limbs 202. The configuration of FIG. 15 simulates the forces applied to the bow 200 during normal usage.

Once the repair or adjustment is completed, the handled 150 is turned in the opposite direction to retract the jack screw 154 to a point that the limbs 202 are in the extended position illustrated in FIG. 14, and the bow 200 can be removed from the bow press 20.

Those having skill in the art will recognize that a bow press in accordance with the disclosure provides significant advantages that greatly facilitate repair and adjustment of compound bows. In particular, it will be noted that the support members 56, 58 positively secure the bow 200 to the bow press 20. The adjustable gap 110 between the wheels 106, 108 concentrates the bending force near the axes 208 of the bow cams 210 to facilitate bending the limbs 202 without damaging the bow 200. The various ratcheting systems permit a single person to mount the bow 200 in the press 20.

Figure 16:
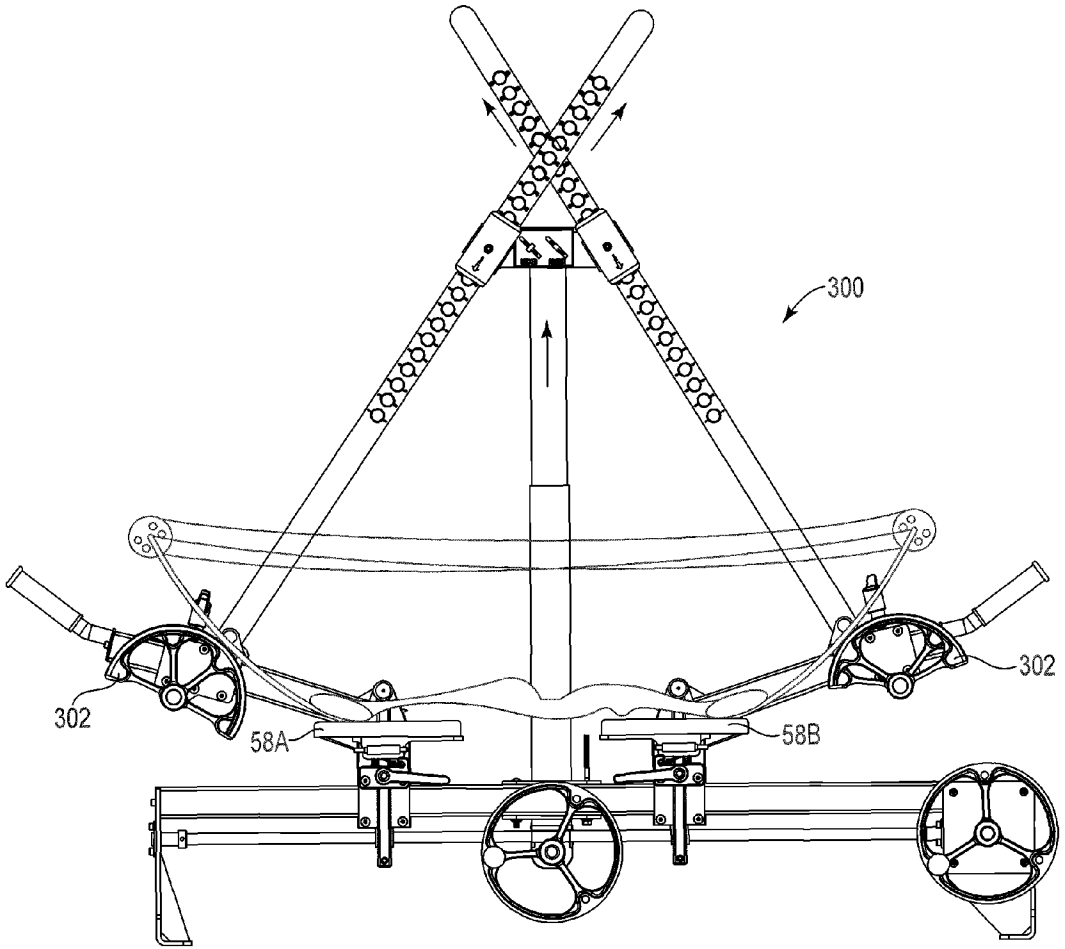
FIG. 16 illustrates an alternate bow press in accordance with an embodiment of the present disclosure.

FIG. 16 illustrates an alternate bow press 300 substantially as shown in FIG. 4, except that the rotating support members 302 are cams or crescent shaped members. In the illustrated embodiment, the outside support members 58A, 58B have also been rotated 180 degrees relative to the support arms 59. The adjustability of the outside support members 58 permits the bow presses 20, 300 to be used with a wide variety of bow designs, as well as many cross bows.

Where a range of values is provided, it is understood that each intervening value, to the tenth of the unit of the lower limit unless the context clearly dictates otherwise, between the upper and lower limit of that range and any other stated or intervening value in that stated range is encompassed within the embodiments of the invention. The upper and lower limits of these smaller ranges which may independently be included in the smaller ranges is also encompassed within the embodiments of the invention, subject to any specifically excluded limit in the stated range. Where the stated range includes one or both of the limits, ranges excluding either both of those included limits are also included in the embodiments of the invention.

Unless defined otherwise, all technical and scientific terms used herein have the same meaning as commonly understood by one of ordinary skill in the art to which the embodiments of the present disclosure belong. Although any methods and materials similar or equivalent to those described herein can also be used in the practice or testing of the embodiments of the present disclosure, the preferred methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the embodiments of the present invention are not entitled to antedate such publication by virtue of prior invention. Further, the dates of publication provided may be different from the actual publication dates which may need to be independently confirmed.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the present disclosure. It should be understood that various features and aspects of the disclosed embodiments can be combined with or substituted for one another in order to form varying modes of the disclosed embodiments of the invention. Thus, it is intended that the scope of at least some of the present invention herein disclosed should not be limited by the particular disclosed embodiments described above.

Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment(s) that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

What is claimed is:

1. A bow press for deflecting the bow limbs attached to a riser of a bow, the bow press comprising:

a support rail including a longitudinal axis and a center portion;

a pair of pivot arms each pivotally attached to pivot arm brackets that slide along the support rail on opposite sides of the center portion;

a pair of opposing support members attached directly to each of the pivot arm brackets that are configured to compressively engage the bow limbs and/or the riser;

a pair of linkage brackets that slide along each of the pivot arms;

a pair of links pivotally connecting the linkage brackets to an actuator mechanism that is adapted to simultaneously move the links toward and ways from the support rail; and linkage bracket support members attached to each of the linkage brackets adapted to engage outside surfaces of the bow limbs, the linkage bracket support members adapted to simultaneously deflect the bow limbs generally away from the support rail and toward the center portion in response to the actuator mechanism moving the links ways from the support rail.

2. The bow press of claim 1 wherein the pair of opposing support members comprise an inside support members moveably attached to each of the pivot arm brackets and an outside support member.

3. The bow press of claim 2 wherein the inside support members include ratcheting mechanisms that permit free movement toward the outside support members, but restricts movement way from the outside support members.

4. The bow press of claim 3 comprising a release that disengages the ratcheting mechanisms so the inside support members can be displaces away from the outside support members.

5. The bow press of claim 1 wherein the pair of opposing support members comprise inside support members attached to each of the pivot arm brackets and outside support members releasably attached to the pivot arm brackets.

6. The bow press of claim 1 comprising a drive mechanism adapted to simultaneous move the pivot arm brackets toward or away from the center portion of the support rail to compensate for the size of the bow.

7. The bow press of claim 1 comprising a ratcheting mechanism engaged with the links that is adapted to adjust a distance between the linkage brackets and the actuator mechanism.

8. The bow press of claim 1 comprising an adjustable locking mechanism attaching the links to the actuator mechanism, the locking mechanism comprising a first position that lock the links in position, a second position that permits the links to slide freely in the locking mechanism, and a third position that permits ratcheting between the links and the locking mechanism.

9. The bow press of claim 1 wherein at least one locking mechanism attaches the links to the actuator mechanism, the locking mechanism comprising:

center pins biased to releasably engage with apertures in the links; and protrusions on the center pins adapted to retain the center pins in a disengaged relationship with the links.

10. The bow press of claim 1 comprising a biasing mechanism adapted to suspend the pivot arms in a neutral position above the support rail.

11. The bow press of claim 1 wherein the linkage bracket support members comprise rotating support members.

12. The bow press of claim 11 wherein the rotating support members comprise one of a wheel, a cam, a crescent shaped structure.

13. The bow press of claim 1 wherein the linkage bracket support members comprise:

at least two freely rotating wheels attached to each of the linkage brackets by shafts; and adjustment mechanisms adapted to adjust a separation between the rotating wheels along the shafts.

14. The bow press of claim 1 wherein the linkage bracket support members are adapted to engage with the bow limbs proximate bow limb cam axes.

15. A bow press for deflecting the bow limbs attached to a riser of a bow, the bow press comprising:

a support rail including a longitudinal axis and a center portion;

a pair of pivot arms each pivotally attached to pivot arm brackets that slide along the support rail on opposite sides of the center portion;

support members attached to the pivot arm brackets that are adapted to engage the bow limbs and/or the riser;

a pair of linkage brackets that slide along each of the pivot arms;

a pair of links pivotally connecting the linkage brackets to an actuator mechanism that is adapted to simultaneously move the links toward and ways from the support rail;

a ratcheting mechanism engaged with the links that is adapted to adjust a distance between linkage brackets and the actuator mechanism, the ratcheting mechanism permitting the links to be freely moved away from the support rail, but restricts movement of the links toward the support rail; and linkage bracket support members attached to each of the linkage brackets adapted to engage outside surfaces of the bow limbs, the linkage bracket support members adapted to simultaneously deflect the bow limbs generally away from the support rail and toward the center portion in response to the actuator mechanism moving the links ways from the support rail.

16. The bow press of claim 15 wherein the ratcheting mechanism comprises a first position that lock the links in position, a second position that permits the links to slide freely in the locking mechanism, and a third position that permits ratcheting between the links and the locking mechanism.

17. The bow press of claim 15 wherein the ratcheting mechanism comprising:

center pins biased to releasably engage with apertures in the links; and protrusions on the center pins adapted to retain the center pins in a disengaged relationship with the links.

18. The bow press of claim 15 wherein the support members comprise an inside support members moveably attached to each of the pivot arm brackets and an outside support member.

19. The bow press of claim 18 wherein the inside support members include ratcheting mechanisms that permit free movement toward the outside support members, but restricts movement way from the outside support members.

20. The bow press of claim 15 comprising a biasing mechanism adapted to suspend the pivot arms in a neutral position above the support rail.

21. The bow press of claim 15 wherein the linkage bracket support members comprise:

at least two freely rotating wheels attached to each of the linkage brackets by shafts; and adjustment mechanisms adapted to adjust a separation between the rotating wheels along the shafts.

22. A bow press for deflecting the bow limbs attached to a riser of a bow, the bow press comprising:

a support rail including a longitudinal axis and a center portion;

a pair of pivot arms each pivotally attached to pivot arm brackets that slide along the support rail on opposite sides of the center portion;

support members attached to the pivot arm brackets that are adapted to engage the bow limbs and/or the riser;

a pair of linkage brackets that slide along each of the pivot arms;

a pair of links pivotally connecting the linkage brackets to an actuator mechanism that is adapted to simultaneously move the links toward and ways from the support rail;

a spring mechanism connecting each of the pivot arms to a respective pivot arm brackets to suspend the pivot arms in a neutral position above the support rail; and linkage bracket support members attached to each of the linkage brackets adapted to engage outside surfaces of the bow limbs, the linkage bracket support members adapted to simultaneously deflect the bow limbs generally away from the support rail and toward the center portion in response to the actuator mechanism moving the links ways from the support rail.

* * * * *